United States Patent [19]

Hatsell

[11] 4,265,553

[45] May 5, 1981

[54] RIBBON THREADING ASSEMBLY FOR AN IMPACT PRINTER

[75] Inventor: William A. Hatsell, Hatfield, Pa.

[73] Assignee: Exxon Research and Engineering Company, Florham Park, N.J.

[21] Appl. No.: 107,935

[22] Filed: Dec. 28, 1979

Related U.S. Application Data

[63] Continuation of Ser. No. 833,273, Sep. 14, 1977, abandoned.

[51] Int. Cl.[3] ..... B41J 31/02

[52] U.S. Cl. ..... 400/238; 400/208; 400/214; 400/242; 400/248; 400/250; 400/697.1

[58] Field of Search ..... 400/238, 242, 250, 208, 400/214, 248, 697.1

[56] References Cited

U.S. PATENT DOCUMENTS

| | | | |
|---|---|---|---|
| 2,276,324 | 3/1942 | Mann | 400/238 |
| 2,652,918 | 9/1953 | Lippert | 400/242 |
| 2,818,155 | 12/1957 | Kizak | 400/238 |
| 3,022,879 | 2/1962 | Heidt et al. | 400/250 |
| 3,108,675 | 10/1963 | Rooney | 400/238 |
| 3,393,790 | 7/1968 | Dixon | 400/242 |
| 3,399,754 | 9/1968 | Rooney | 400/238 |
| 3,782,651 | 1/1974 | Hengelhaupt et al. | 400/242 |
| 3,935,939 | 2/1976 | Schmidt et al. | 400/242 X |

*Primary Examiner*—Ernest T. Wright, Jr.
*Attorney, Agent, or Firm*—Norman L. Norris

[57] ABSTRACT

Disclosed is an assembly for threading a ribbon, preferably an erase ribbon through an impact printer such as a typewriter. One end of the ribbon is stored at a ribbon storage means, while the other end of the ribbon has a tab fastened thereto. The longitudinal dimension of the tab is perpendicular to the longitudinal dimension of the ribbon and the tab contains a frangible portion which is used for finger engagement during the threading operation. The ribbon take-up reel contains a slot in one of the flanges thereof such that the ribbon tab may be inserted into the slot after the ribbon has been threaded through the printer. The frangible portion is then separated from the ribbon and discarded.

9 Claims, 8 Drawing Figures

RIBBON THREADING ASSEMBLY FOR AN IMPACT PRINTER

This is a continuation of application Ser. No. 833,273, filed Sept. 14, 1977, now abandoned.

BACKGROUND OF THE INVENTION

This invention relates in general to impact printers, and more particularly, it relates to impact printers wherein an erase ribbon is positioned adjacent a moving print point.

In various printers including typewriters such as those manufactured by IBM and SCM, the platen which supports the print receiving medium in the impact printing position remains stationary and the character printing elements move along the platen on a carriage to various printing locations. In those printers, an erase ribbon supply reel and an erase ribbon take-up reel have been mounted for movement on the carriage with the character elements and the print point. The character elements may be mounted on a ball or on a wheel oftentimes referred to as a daisy. In those type printers in which the character elements are mounted on a ball, the erase ribbon has been typically positioned between the print ribbon and the platen and thus it has been difficult to thread the erase ribbon around the guides and lifters and between the ink ribbon and the platen in the confined space available. Further, in at least one printer in which the character elements have been mounted on a wheel such as that disclosed in copending application Ser. No. 833,272 of Hatsell, filed Sept. 14, 1977, assigned to the assignee of this invention, the erase ribbon is mounted beneath the ink ribbon rather than between it and the print point and accordingly, the threading of the erase ribbon is even more difficult than when the erase ribbon and the print ribbon are side by side.

SUMMARY OF THE INVENTION

It is an object of this invention to provide an erase ribbon assembly which simplifies the threading of the ribbon.

It is a further object of this invention to provide an erase ribbon with a means for simplifying the insertion of the ribbon upon a ribbon take-up reel.

It is still a further object of this invention to provide an erase ribbon take-up reel which has been adapted to be more easily threaded than those known to the prior art.

These and other objects of the present invention are accomplished by means of an erase ribbon having a tab fastened to one end thereof. The longitudinal dimension of the tab is substantially perpendicular to the longitudinal dimension of the ribbon. The tab is adapted to mate with a slot formed in a flange of the ribbon take-up reel. In one embodiment of the present invention, the tab has a frangible portion such that after the ribbon is threaded through the machine and the tab is inserted within a slot formed in the take-up reel, the frangible portion may be removed.

The present invention will be better understood by reference to the accompanying drawing in which.

DETAILED DESCRIPTION OF A PREFERRED EMBODIMENT

Figure 1:
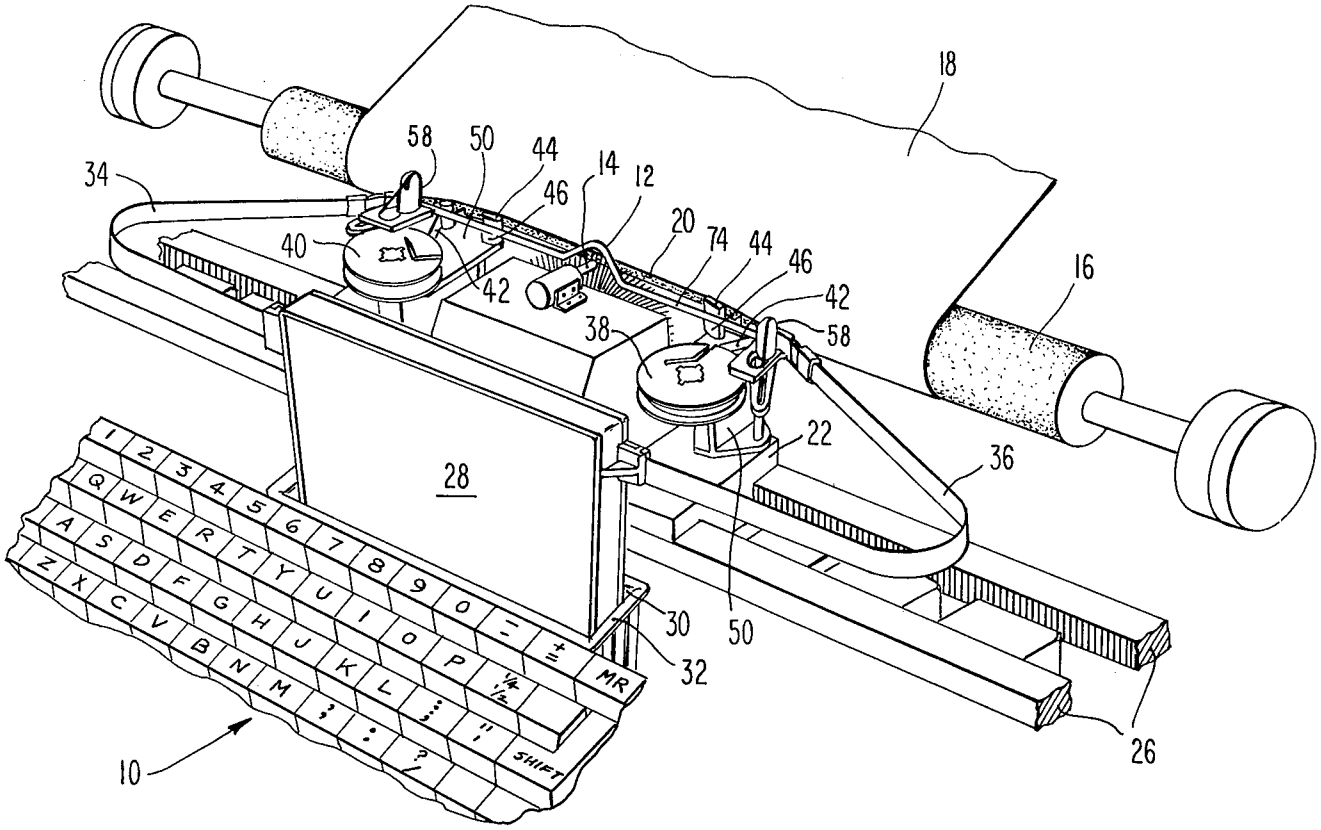
FIG. 1 is a perspective view of a printer incorporating the present invention.
Figure 2:
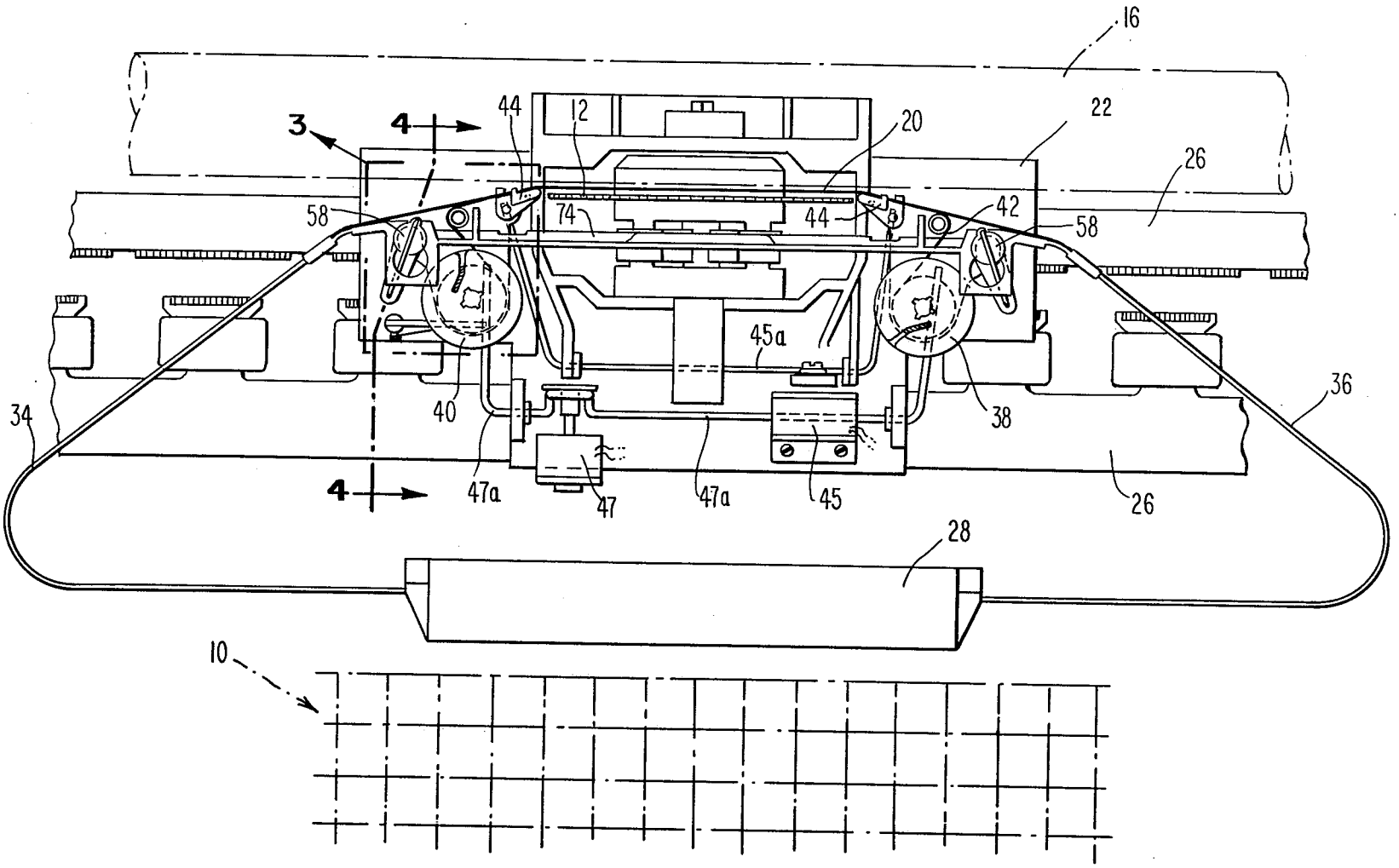
FIG. 2 is a top view of the printer shown in FIG. 1.

A printer comprising a typewriter shown in FIGS. 1 and 2 includes a keyboard 10 having a multiplicity of keys corresponding to various characters which, upon depression, control the position of a rotatable character array in the form of a print wheel or daisy 12 juxtaposed between impact means in the form of a hammer 14 and a platen 16. The platen 16 is adapted to support a print receiving medium in the form of paper 18 which is contacted by the marking medium in the form of a print ribbon 20 which is located between the print wheel 12 and the paper 18 so as to leave a mark in ink corresponding to the particular character of the print wheel 12 which is in position between the hammer 14 and the paper 18.

As shown in FIG. 1, the print wheel 12 and the hammer 14 are mounted on a carriage 22 which is adapted to move in a lateral direction parallel with the surface of the platen 16 so as to position the print wheel 12 at various positions along the paper 18 in response to the depression of keys on the keyboard 10. As the carriage 22 is moved, the print wheel 12 rotates so as to position the proper character element at the end of a radially extending spoke in a printing position aligned with the print hammer 14. The lateral movement of the carriage 22 along the support surfaces 26 may be achieved by various means known in the art including a linear stepper motor such as that shown in copending application Ser. No. 833,271 of Matthias and Thornton, filed Sept. 14, 1977, now U.S. Pat. No. 4,149,808 issued Apr. 17, 1979, assigned to the assignee of this invention.

In accordance with copending application Ser. No. 833,270 of Matthias, filed Sept. 14, 1977, assigned to the assignee of this invention, the print ribbon 20 is stored within a housing of a stationary cartridge 28 which is received, by a pocket 30 in an integrally molded receptacle 32. As shown in FIG. 1, the ribbon path length between the print point as determined by the position of the carriage 22 and the cartridge 28 is maintained constant over a substantial portion thereof by a first flexible leader 34 which extends from the cartridge 28 to the carriage 22 and a second flexible leader 36 which extends from the carriage 22 to the cartridge 28.

Between the first flexible leader 34 and the second flexible leader 36 a segment of the ribbon 20 is exposed and this segment is to be positioned adjacent the print point.

As more clearly pointed out in copending application Ser. No. 873,714 of Miller and Rello, filed Jan. 30, 1978, assigned to the assignee of this invention, situated within the cartridge 28 is a supply reel and a take-up reel (not shown) upon which the print ribbon 20 is wound. Further, a drive means (not shown) is associated with the supply reel and the take-up reel so as to continuously supply a fresh segment of ribbon 20 to the print point.

In addition to the hammer 14, the carriage 22 also supports and transports an erase ribbon supply reel 38 and an erase ribbon take-up reel 40. Wound around the erase ribbon supply reel 38 and positioned adjacent but below the moving print point is an erase ribbon 42 which may be used to remove characters which have been formed on the paper 18 by the print ribbon 20.

Also supported on and transported by the carriage 22 is a mechanism for lifting the print ribbon 20 and the erase ribbon 42 from their rest positions below the print point to their operating positions at the print point. The ribbons 20, 42 are raised and lowered in order that the operator of the printer is able to observe each printed character after it has been formed on the print receiving medium 18. The print ribbon 20 is elevated to its operating position when a key of keyboard 10 is depressed. However, the erase ribbon 42 is elevated to its operating position only when the printer is operating in an erase mode. At all other times, the print ribbon 20 and the erase ribbon 42 are maintained in their rest positions below the print point. The particular lifting mechanisms for both of these ribbons 20, 42 are the subject of copending application Ser. No. 833,272 of Hatsell, filed Sept. 14, 1977, assigned to the assignee of this invention. However, portions of the lifting mechanism will be described here for the sake of clarity.

Figure 3:
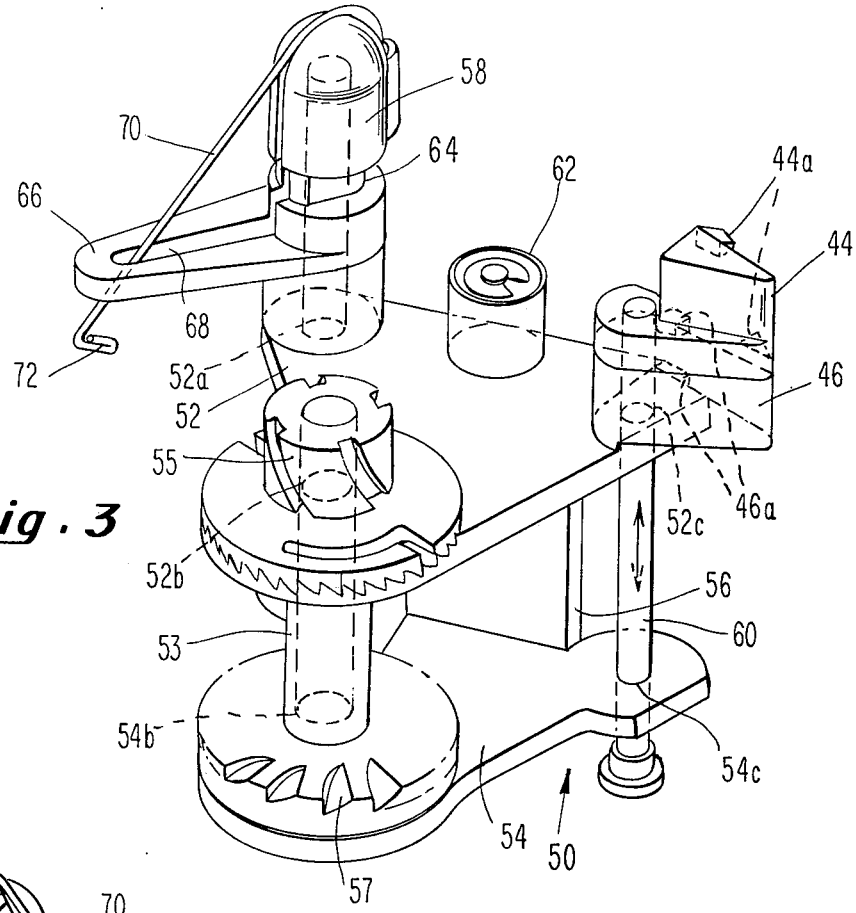
FIG. 3 is a perspective view of a ribbon mounting and lifting unit which has been shown generally outlined by a dotted portion 3 of FIG. 2.

The print ribbon 20 is elevated to its operating position by means of a pair of ink ribbon lifters 44 which may best be seen from FIG. 3. The erase ribbon 42 is elevated to its operating position by means of a pair of erase ribbon lifters 46. The print ribbon lifters 44 are situated directly above the erase ribbon lifters 46. Lifters 44 and 46 each contain notches 44*a* and 46*a* respectively which cradle the ribbons 20 and 42.

Figure 4:
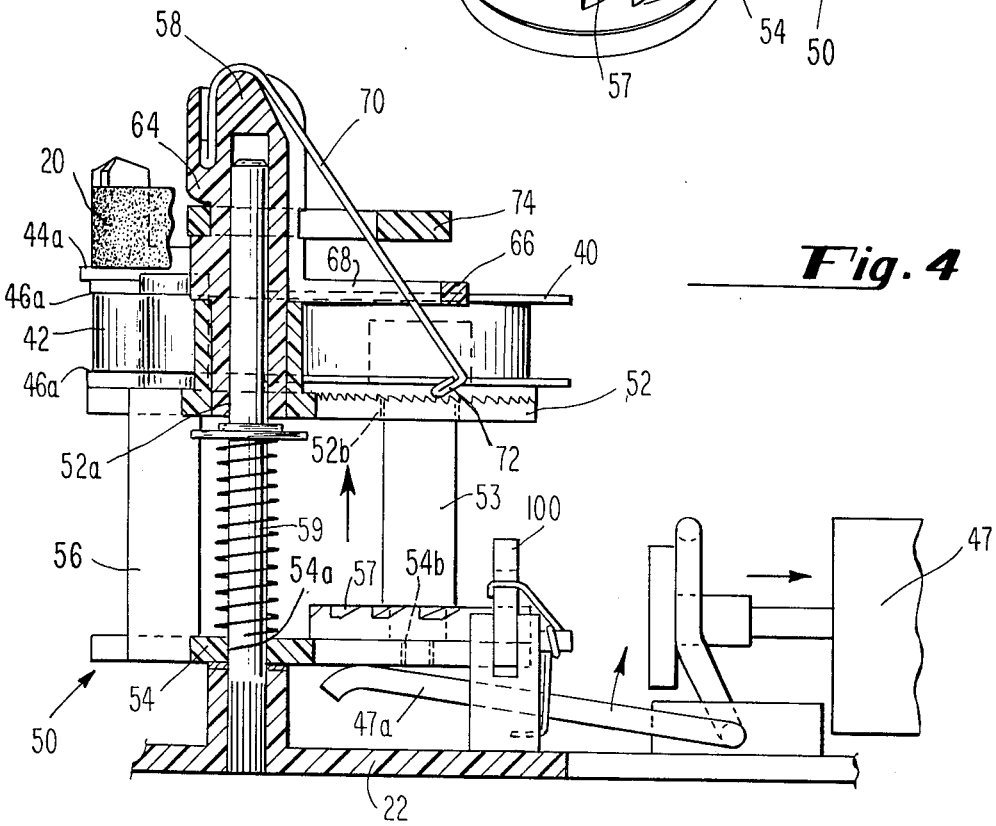
FIG. 4 is a partial sectional view taken along line 4—4 of FIG. 2.

The lifters, 44, 46 are elevated by means of a print ribbon lift magnet 45 and its associated linkage 45*a* and an erase ribbon lift solenoid 47 and its associated linkage 47*a* respectively as shown in FIGS. 2 and 4.

The lifters 44 and 46 are supported on raisable brackets, one of which is shown generally at 50, which may best be seen in perspective in FIG. 3 and in cross-section in FIG. 4. In the preferred embodiment, the brackets 50 comprise a first planar surface 52 and a second planar surface 54 which are substantially parallel to one another and spaced apart by means of a support 56. Both of the planar surfaces 52 and 54 are pierced by a plurality of apertures 52*a*, 52*b*, and 52*c* and 54*a*, 54*b* and 54*c* respectively.

Covering the aperture 52*a* on the upper surface of planar surface 52 is an upwardly extending pier 58 which is integral with the bracket 50. The pier 58 contains a bore therein which is aligned with aperture 52*a* and which is slideably mounted over a stationary pin 59 (FIG. 4) which is attached to and transported by the carriage 22 and which also passes through the aperture 54*a* of the second planar surface 54.

In the preferred embodiment, the pier 58 is formed to a generally cylindrical shape having a first outside diameter. However, as shown in FIG. 3, the pier 58 has a region of generally reduced diameter 64 below which is an outwardly extending flange 66. The flange 66 contains a slot 68 therein. A spring means 70 fastened to the top of the pier 58, as shown, extends through the slot 68 and is fabricated such that at the slot 68, it is biased away from the pier 58. Further, in the preferred embodiment, the spring means 70 includes a foot 72. Passing through apertures 52*b* and 54*b* is a spindle 53 having a top portion 55 around which the erase ribbon supply reel 38 and the erase ribbon take-up reel 40 rotate. On the side of the printer on which the erase ribbon take-up reel 40 is found, the bottom portion 57 of the spindle 53 is ratcheted such that a pawl 100 mating with the ratchet of the spindle 53 will impart rotational movement to the take-up reel 40 to advance the erase ribbon 42. Passing through aperture 52*c* and 54*c* is a shaft 60. The shaft 60 passes through and is unattached to the erase ribbon lifter 46; however, the shaft 60 is fixedly mounted to the print ribbon lifter 44, such that a movement of the shaft 60 will be imparted to the print ribbon lifter 44 but not to the erase ribbon lifter 46. Activation of the print ribbon magnet 45 causes its associated linkage 45*a* to elevate the shaft 60 and, thus, the print ribbon lifter 44 to the print point. Activation of the erase ribbon solenoid 47 and its associated linkage 47*a* cause each of the brackets 50 to slide along the stationary pins 59 and thus be elevated into the erase ribbon operating position. As may be appreciated from FIG. 4, when the bracket 50 is elevated, both the print ribbon lifter 44 and the erase ribbon lifter 46 as well as the erase ribbon supply and take-up reels 38 and 40 respectively are elevated.

Further, each of the planar surfaces 52 is provided with an erase ribbon guide member 62 which maintains the erase ribbon 42 in tension as it proceeds from the erase ribbon supply reel 38 to the erase ribbon take-up reel 40.

In a preferred embodiment, and as disclosed in copending application Ser. No. 833,252 of Hatsell, filed Sept. 14, 1977, assigned to the assignee of this invention, the print ribbon 20 and the cartridge 28 from which it is supplied may easily be changed by the operator of the printer by means of a ribbon bridge member 74 which is attached to the flexible leaders 34 and 36 and which is adapted to be mounted on the piers 58 which align and position the print ribbon 20 adjacent the print point. The bridge member 74 is retained on the piers 58 by means of the spring means 70.

However, in accordance with the teachings of the present invention a means is also provided whereby the operator may quickly and easily change the erase ribbon 42 as well as the ink ribbon 20.

Figure 5:
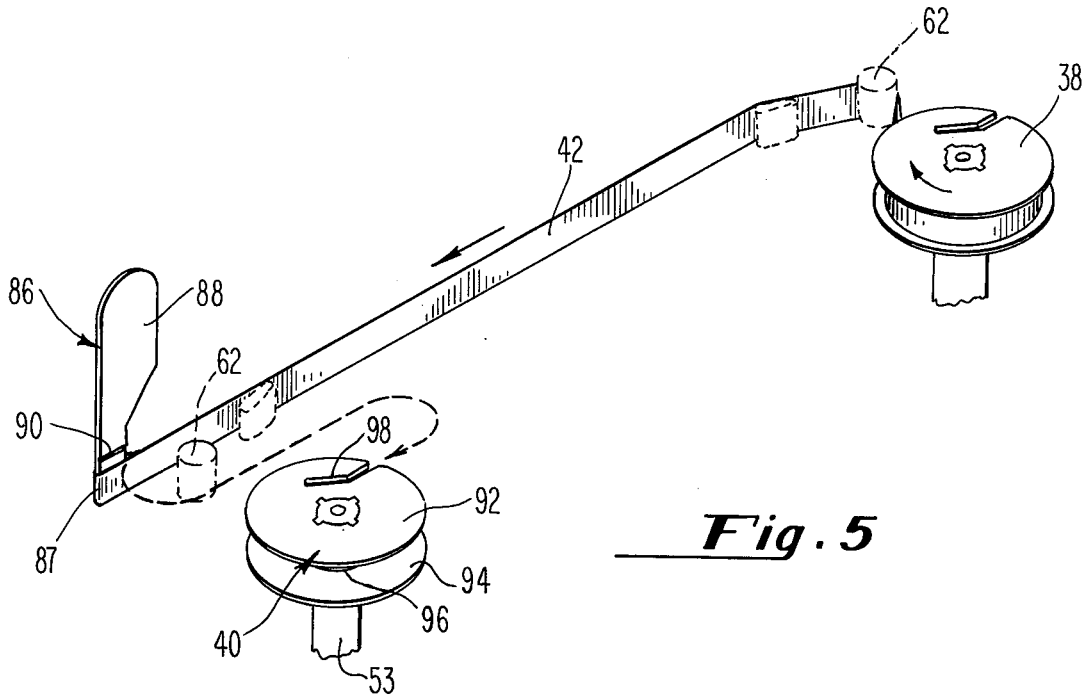
FIG. 5 is a perspective view of an erase ribbon and an erase ribbon supply and take-up reel constructed in accordance with the present invention.

Thus, referring to FIG. 5, the erase ribbon 42 is supplied with an upwardly extending tab shown generally at 86. The tab 86 is preferably formed of a plastic material such as polycarbonate. However, the tab 86 may also be formed as an integral part of the ribbon 42 itself. The longitudinal axis of the tab 86 is generally perpendicular to the longitudinal axis of the erase ribbon 42.

The proximate end 87 of the tab 86 is preferably joined to the erase ribbon 42 by means of a suitable adhesive and the distal end is preferably formed to have an enlarged portion 88 for easy finger engagement.

Situated between the proximate and distal ends of the tab 86 is a score line 90, the function of which will be more fully described below.

Further, as may be best seen in FIG. 5, the erase ribbon take-up reel 40 comprises an upper flange 92 and a lower flange 94 joined by a central hub portion 96. In accordance with the present invention, the upper flange 92 of the erase ribbon take-up reel 40 is provided with a slot 98.

Figure 6:
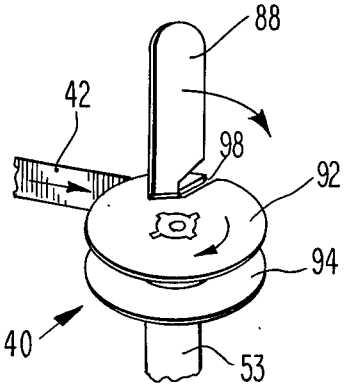
FIGS. 6–8 illustrate various steps in a method of using the assembly of the present invention.
Figure 7:
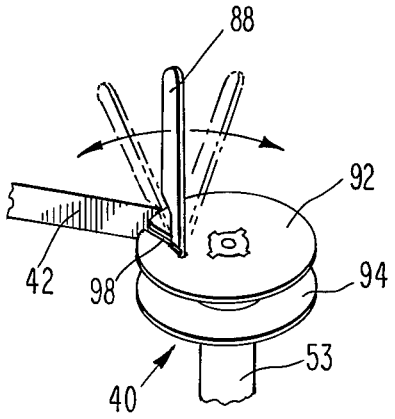
Figure 8:
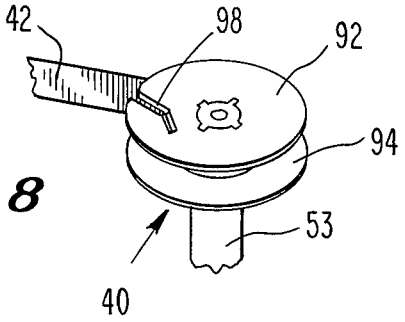

In threading the erase ribbon 42, the operator positions the ribbon storage means such as the erase ribbon supply reel 38 in the appropriate position on the spindle 53. The erase ribbon take-up reel 40 is also located in position. The operator then grasps the enlarged portion 88 of the tab 86 with the fingers. In this manner, the ribbon 42 supplied from the supply reel 38 is moved around the guides 62 and the lifters 46 along the ribbon path near the print point. As shown in FIG. 6, the ribbon 42 is then inserted in the slot 98 of the erase ribbon take-up reel 40. The reel 40 is then rotated to wind and apply tension to the ribbon 42. Next, (as shown in FIG. 7) the distal end of the tab 86 is removed by breaking it at the score line 90 and discarded. The erase ribbon take-up reel 40 is then ready for use as shown in FIG. 8. In this manner, the operator is able to thread the erase ribbon 42 through a confined area without difficulty.

Although a particular embodiment has been shown and described, various modifications may be made which fall within the true spirit and scope of the invention as set forth in the appended claims.

What is claimed is:

1. A ribbon assembly for an impact printer comprising:

a ribbon, one end of which is stored at a ribbon storage means;

a tab having a proximate and a distal end, the proximate end being attached to the other end of said ribbon, the longitudinal dimension of said tab being substantially perpendicular to the longitudinal dimension of said ribbon; and a ribbon take-up reel having flanges separated from one another by a hub, one of said flanges having a slot therein for mating with the proximate end of said tab, said proximate and said distal ends being separated by a score line whereat said distal end may be removed from said proximate end.

2. The assembly of claim 1 wherein said distal end comprises an enlarged portion compared to said proximate end for finger engagement.

3. The assembly of claim 1 wherein said proximate end is fastened to said ribbon by an adhesive.

4. The assembly of claim 1 wherein said tab comprises a plastic material.

5. The apparatus of claim 4 wherein said plastic material comprises polycarbonate.

6. The assembly of claim 1 wherein said tab is integral with said ribbon.

7. The assembly of claim 1 wherein said ribbon storage means comprises a supply reel.

8. The assembly of claim 7 wherein said supply reel comprises two flanges separated from one another by a hub, at least one of said flanges having a slot therein for mating with said tab.

9. A method of threading a ribbon through a path near the print point of an impact printer, said method comprising:

supplying a ribbon, one end of which is stored at a ribbon storage means;

grasping a tab, said tab having a longitudinal dimension which is substantially perpendicular to the longitudinal dimension of said ribbon, and being attached to the other end of said ribbon, said tab having a distal end which is removable from said ribbon and a proximate end which is fastened to said ribbon;

moving said ribbon along said path;

winding said ribbon on a take-up reel, said reel having a flange with a slot therein, said proximate end of said tab mating with said slot; and removing said distal end of said tab, by breaking said tab at a score line formed between said distal end and said proximate end.

* * * * *